US009908230B2

(12) United States Patent
Tsai

(10) Patent No.: US 9,908,230 B2
(45) Date of Patent: Mar. 6, 2018

(54) TOOL ASSEMBLY

(71) Applicant: Chung-Yu Tsai, Taichung (TW)

(72) Inventor: Chung-Yu Tsai, Taichung (TW)

( * ) Notice: Subject to any disclaimer, the term of this patent is extended or adjusted under 35 U.S.C. 154(b) by 290 days.

(21) Appl. No.: 14/985,466

(22) Filed: Dec. 31, 2015

(65) Prior Publication Data

US 2017/0190040 A1 Jul. 6, 2017

(51) Int. Cl.
*B25F 1/04* (2006.01)
*B25B 15/00* (2006.01)
*B25G 1/08* (2006.01)

(52) U.S. Cl.
CPC ..... *B25F 1/04* (2013.01); *B25B 15/008* (2013.01); *B25G 1/085* (2013.01)

(58) Field of Classification Search
CPC ..... B25F 1/04; B25F 1/02; B25G 1/08; B25G 1/085; B25B 15/004; B25B 15/008
See application file for complete search history.

(56) References Cited

U.S. PATENT DOCUMENTS 6,564,678 B1 * 5/2003 Wang ..... B25B 13/56 7/118
7,281,455 B2 * 10/2007 Hu ..... B25G 1/085 81/177.4
8,074,541 B2 * 12/2011 Adamany ..... B25F 1/04 362/119
9,463,568 B2 * 10/2016 Chen ..... B25G 1/063
2010/0229342 A1 * 9/2010 Chen ..... B25G 1/085 16/111.1
2014/0041128 A1 * 2/2014 Wang ..... B25F 1/04 7/118
2014/0069236 A1 * 3/2014 Liu ..... B25B 13/56 81/60

* cited by examiner

*Primary Examiner* — David B Thomas

(57) ABSTRACT

A tool assembly includes a first part, a second part, an operation member, two second tool units, and two first connection members. The first part has a first space, two first rails, two first engaging portions, two second spaces and two first connection portions. The second part has a head and a receiving portion which is insertion in the first space and includes receiving units for receiving first tools therein. Two second rails are formed on the second part and slidably engaged with the first rails. The operation member is connected to the second part. The two second tool units are pivotably connected to the two first connection portions and located in the two second spaces. The second tool units each have second tools which are pivotable about the first connection portion corresponding thereto. The first tools can be removed from the receiving units and connected to the operation member.

8 Claims, 8 Drawing Sheets

A-A

TOOL ASSEMBLY

BACKGROUND OF THE INVENTION

1. Fields of the Invention

The present invention relates to a tool assembly, and more particularly, to a tool assembly having multiple different tools.

2. Descriptions of Related Art

The conventional tool assembly is disclosed in U.S. Pat. No. 6,119,560, and comprises a handle having an elongated body which has oppositely disposed handle ends. A first tool means comprises sleeve means, and means for pivotally connecting the sleeve means to the handle disposed adjacent one handle end. The sleeve means comprises means for removably receiving at least one tool bit. The sleeve means is pivoted from an inoperable position adjacent the handle to an operable position disposed away from the handle. The at least one said tool bit is disposed in the sleeve means in the operable position. A second tool means comprises means for engaging a tool element, and means for pivotally connecting the second tool means to the handle adjacent the other handle end. The second tool means is pivoted to an operable position to engage the tool element. There is a telescoping magnet means and means for connecting the telescoping magnet means to the handle. The means for connecting the telescoping magnet means comprises means for pivotally connecting the telescoping magnet means to said handle. The hand tool is alternatively operable as a first tool, a second tool or a telescoping magnet.

However, the outer sleeve and the inner sleeve can only receive the first and second drive bits, the number of the drive bits is limited and the space for the drive bits cannot be expandable. The first and second drive bits are all received in the inner sleeve, when the user wants to use the second bits, the second bits have to be removed from the outer sleeve, and then connected to the inner sleeve in reverse direction. The steps are complicated and inconvenient.

The present invention intends to provide a tool assembly to eliminate the shortcomings mentioned above.

SUMMARY OF THE INVENTION

The present invention relates to a tool assembly and comprises a first part, a second part, an operation member, two second tool units, and two first connection members. The first part has a first space, two first rails, two first engaging portions, two second spaces and two first connection portions. The second part has a head and a receiving portion which is insertion in the first space and includes receiving units for receiving first tools therein. Two second rails are formed on the second part and slidably engaged with the first rails. The operation member is connected to the second part and has a head exposed from the second part. The two second tool units are pivotably connected to the two first connection portions and located in the two second spaces. The second tool units each have second tools which are pivotable about the first connection portion corresponding thereto. The first tools can be removed from the receiving units and connected to head of the operation member which has a ratchet mechanism.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
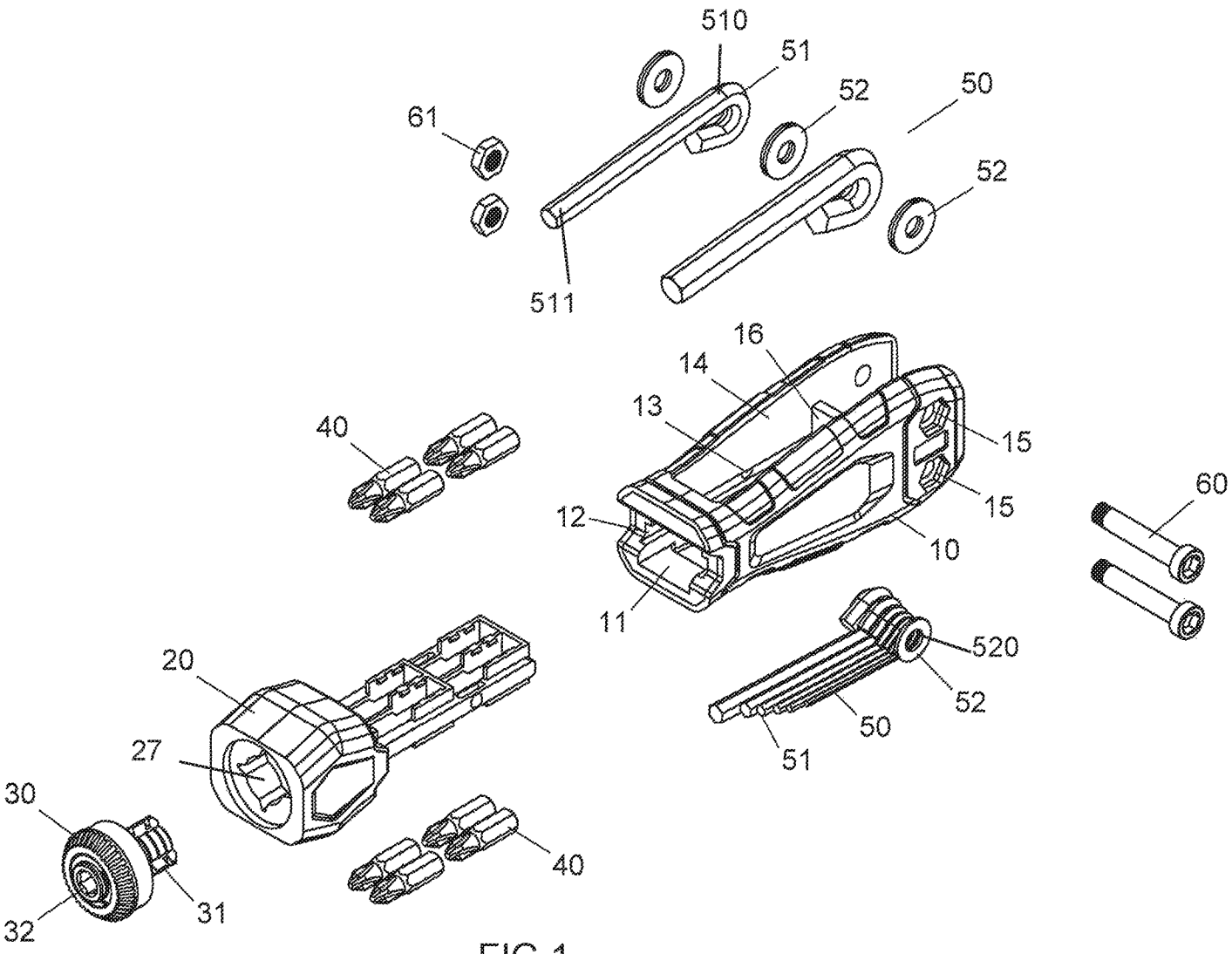
FIG. 1 is an exploded view of the tool assembly of the present invention.
Figure 2:
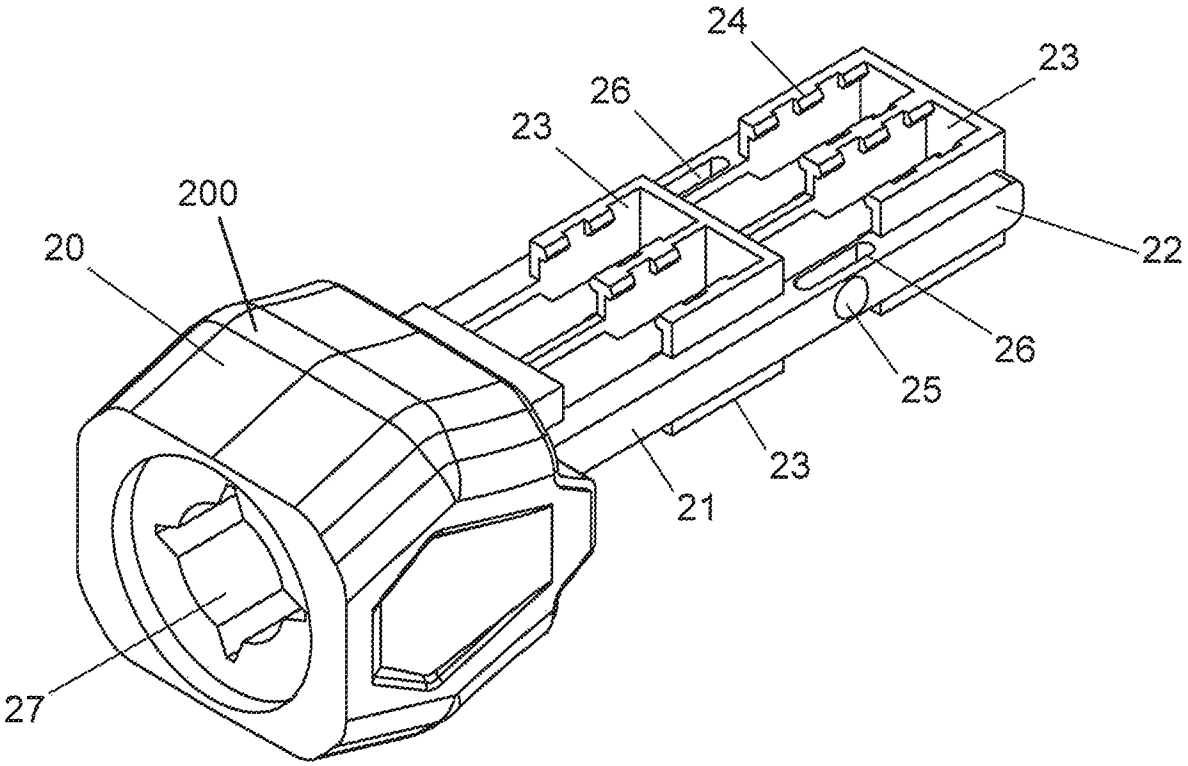
FIG. 2 is a perspective view to show the second part of the tool assembly of the present invention.
Figure 3:
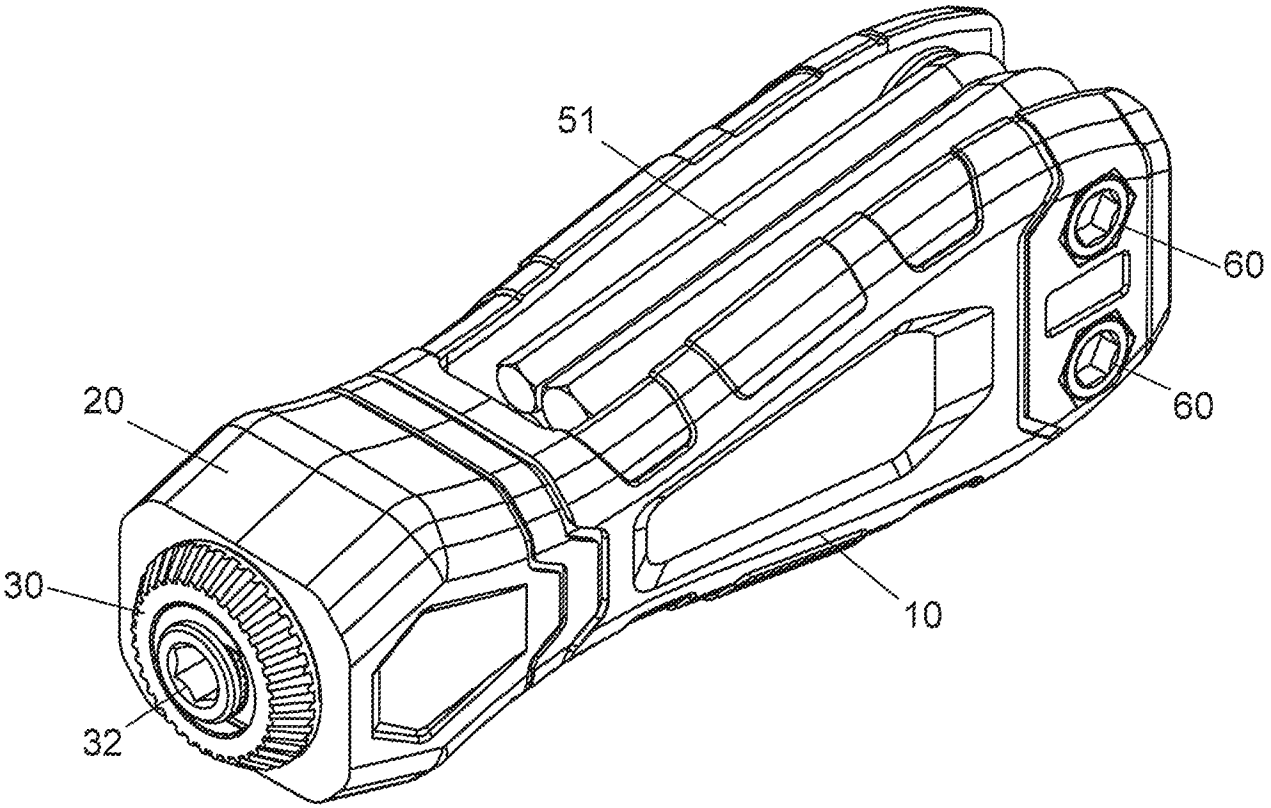
FIG. 3 is a perspective view to show the tool assembly of the present invention.

Referring to FIGS. 1 to 3, the tool assembly of the present invention comprises a first part 10, a second part 20, an operation member 30, multiple first tools 40, two second tool units 50, two cylindrical first connection members 60 and two second connection members 61.

The first part 10 has a first space 11 defined therein, and a first rail 12 is formed in each of two insides of the first space 11. Each first rail 12 has a first engaging portion 13 which are circular recesses. Two second spaces 14 are respectively defined in the top and the bottom of the first part 10. The two second spaces 14 is symmetrical to each other, and the first rails 12 are located between the first space 11 and the second spaces 14. Two first connection portions 15 are defined in each of two sides of the first end of the first part 10. The two first connection portions 15 are sink holes. A separation portion 16 is located in the first part 10 and located close to the first end of the first part 10.

The second part 20 has a head 200 and receiving portion 21, wherein the receiving portion 21 is inserted into the first space 11 of the first part 10, and the head 200 is exposed beyond the second end of the first part 10. The distal end of the receiving portion 21 contacts the separation portion 16. A second rail 22 is formed on each of two sides of the insertion portion 21. The second rails 22 is slidably engaged with the first rails 12. Each second rail 22 has a second engaging portion 25 which is a circular protrusion which is removably engaged with the first engaging portion 13 corresponding thereto so as to restrict the receiving portion 21 in the first space 11. The receiving portion 21 has multiple receiving units 23 defined in the top and the bottom thereof, and each receiving unit 23 has a restriction portion 24 protruding therefrom. There are eight receiving units 23 and each receiving unit 23 is an elongate and rectangular recess. A through hole 26 is defined through each of the second rail 22 and located beyond the second engaging portion 25 so that the second engaging portion 25 is pushed to squeeze the through hole 26 when the second engaging portion 25 moves over the first engaging portion 13. A first connection hole 27 is defined in the head of the second part 20 and the first connection hole 27 is a non-circular hole.

The operation member 30 has an insertion 31 which is inserted into the first connection hole 27 of the second part 20. The operation member 30 has a second insertion hole 32 which is located outside of the second part 20, and the second insertion hole 32 is a hexagonal hole 32. The operation member 30 includes a ratchet mechanism.

The first tools 40 are respectively put in the receiving units 23 of the second part 20 and restricted by the restriction portions 24. Each first tool 40 is a hexagonal wrench, and there are eight or nine first tools. The first tool 40 can be picked out from the receiving unit 23 corresponding by forcibly passing over the restriction portion 24. The first tool 40 can be inserted into the second insertion hole 32 of the operation member 30 as shown in FIG. 6.

Figure 4:
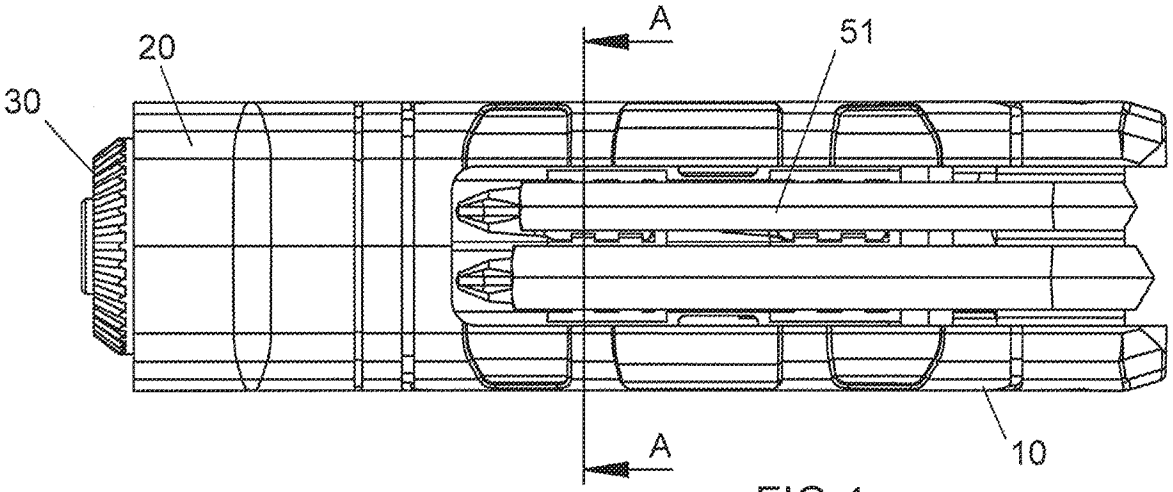
FIG. 4 is a top view of the tool assembly of the present invention.
Figure 5:
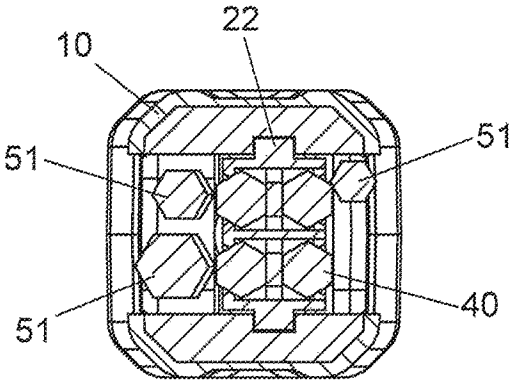
FIG. 5 is a cross sectional view, taken along line A-A of FIG. 4.

As shown in FIGS. 4 and 5, the two second tool units 50 are respectively and pivotably connected to the first connection portions 15 of the first part 10 and located in the two second spaces 14. The second part 20 is located between the two second tool units 50. Each of the two second tool units 50 has multiple second tools 51 and multiple separation members 52. Each second tool 51 has a first pivotal portion 510 and a function end 511 on two ends thereof. The second tools 51 each have the bent first pivotal portion 51 and an elongate rod extending from the first pivotal portion 51, the elongate rod has a hexagonal cross section. The function end 511 of each second tool 51 is located in the second space 14. The first pivotal portion 510 of each second tool 51 being pivotable about an axis of the first connection portion 15 corresponding thereto and the function end 511 of each second tool 51 protrudes from the first part 10. Each second tool 51 is located between two of the separation members 52. Each separation member 52 has a second pivotal portion 520 which is located in alignment with the first pivotal portion 510 of each second tool 51 and the first connection portion 15.

The two first connection members 60 respectively extend through the two first connection portions 15, the first pivotal portions 510 and the second pivotal portions 520 of the separation members 52 of the two second tool units 51 so as to pivotally connect the two second tool units 50 to the first part 10. The second tools 51 are pivotable about the first connection members 60. The first connection members 60 each have a threaded section, and the two threaded sections of the two first connection members 60 extend through the first part 10 and are threadedly connected to two second connection members 61 which are located in the first connection portions 15 in one side of the first part 10. In this embodiment, the second connection members 61 are screw nuts.

Figure 6:
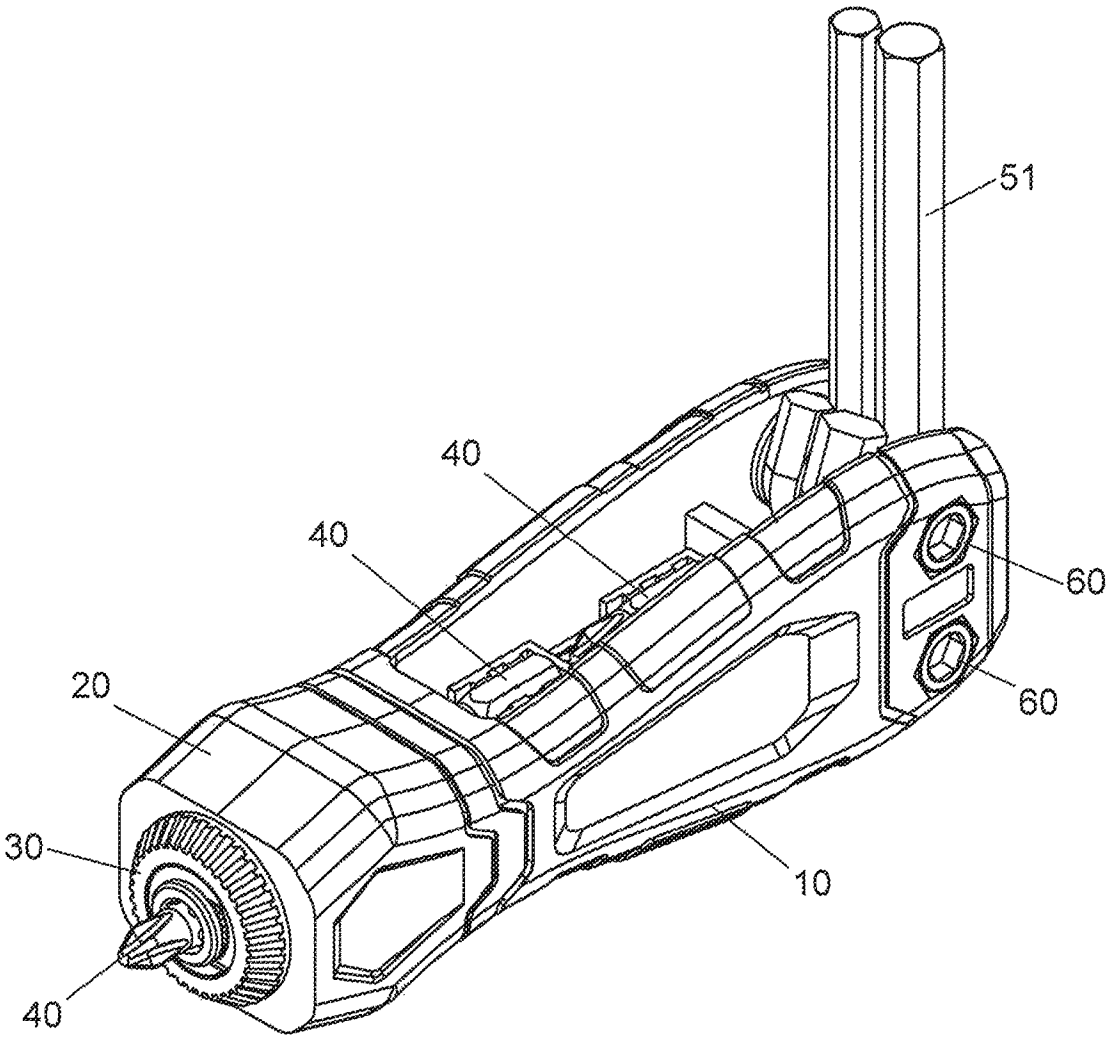
FIG. 6 shows that two second tools are pivoted upward, and a first tool is connected with the operation member.
Figure 7:
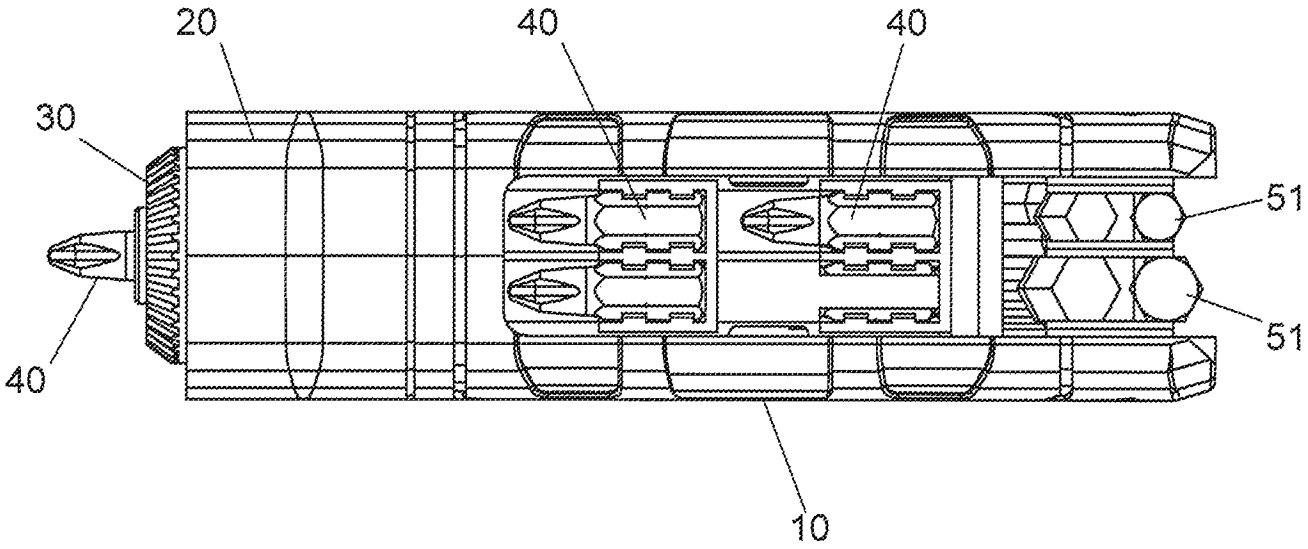
FIG. 7 is a top view of the status disclosed in FIG. 6.

As shown In FIGS. 6 and 7, any of the first tools 40 can be picked out from the receiving unit 23 and then is inserted into the second insertion hole 32 of the operation member 30. By rotating the first part 10 to rotate the first tool 40. Alternatively, by pivoting any of the second tools 50 to le the function end 511 be exposed beyond the first part 10. The user may hold the first part 10 to rotate the second tool 51.

Figure 8:
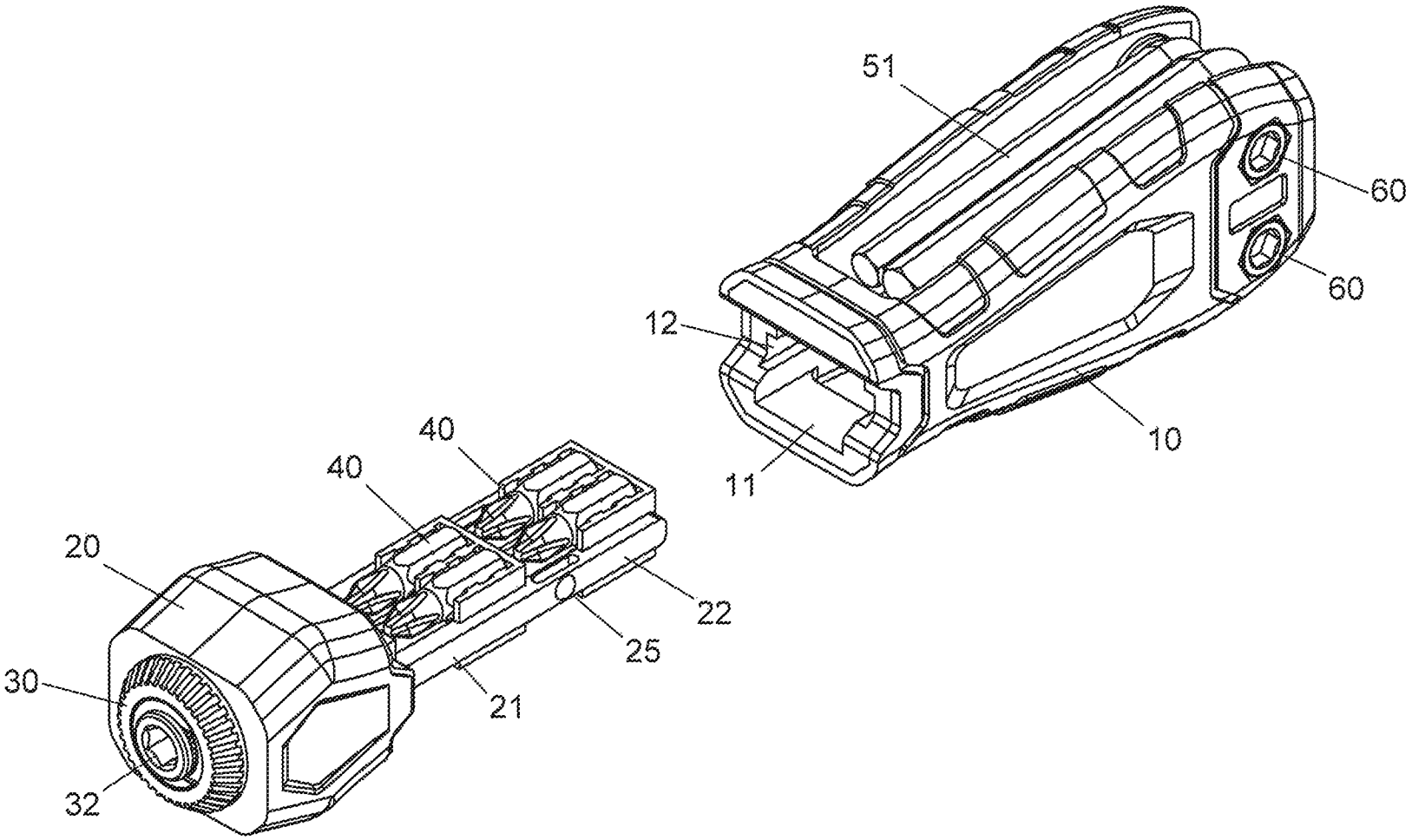
FIG. 8 shows the first part and the combination of the second part and the operation member.

As shown in FIG. 8, the second rails 22 are slidably engaged with the first rails 12, and the first engaging portions 13 are engaged with the second engaging portions 25. By applying a force, the second rails 22 can be separated from the first rails 12, and the second part 20 can be removed from the first space 11.

Figure 9:
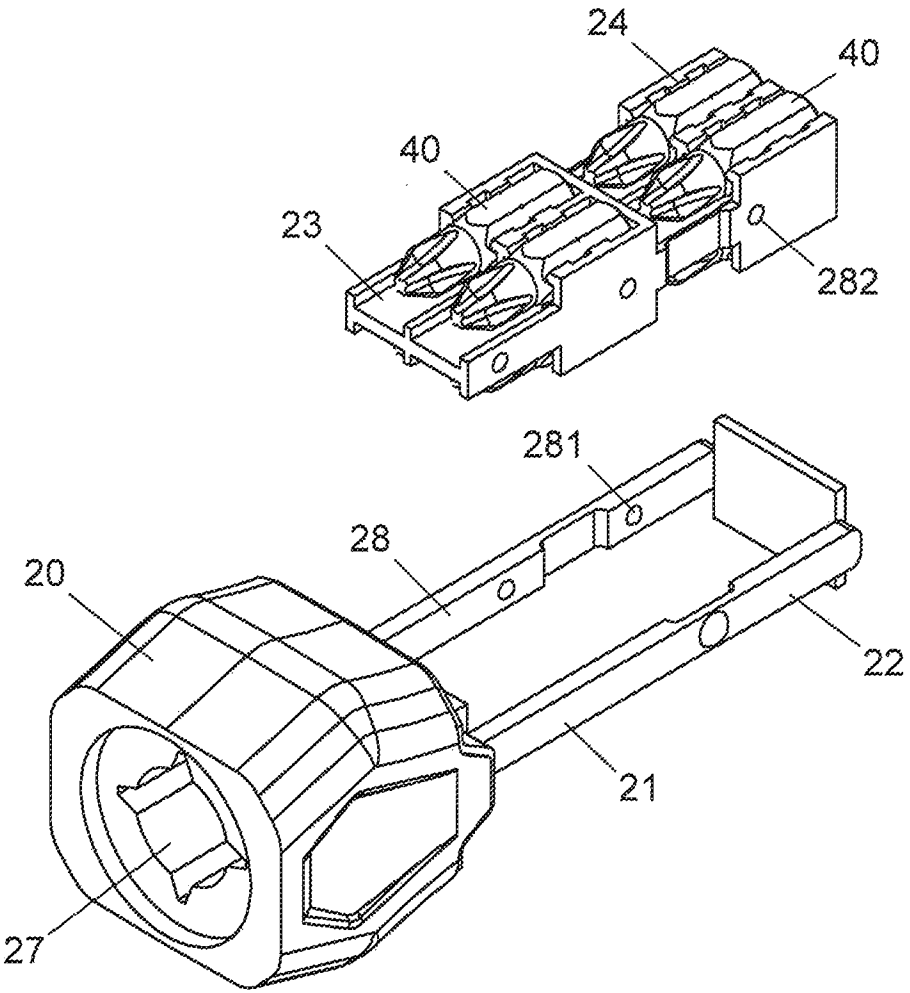
FIG. 9 is a perspective view to show second embodiment of the second part of the tool assembly of the present invention.

As shown in FIG. 9, the second part 20 and the combination of the receiving units 23 can be two individual elements. The combination of the receiving units 23 is detachably connected to the receiving portion 21. The receiving portion 21 has a third space 28, and two third engaging portions 281 are connected to two insides of the third space 28. The third engaging portions 281 are circular recesses. The receiving units 23 are received in the third space 28 and have fourth engaging portions 282 on two sides thereof. The fourth engaging portions 282 are engaged with the third engaging portions 281. In this embodiment, the fourth engaging portions 282 are circular protrusions.

The tool assembly has more than four receiving units 23 so as to carry multiple first tools 40, and the first tools 40 are restricted by the restriction portions 24 and do not drop randomly. As shown in FIGS. 6 and 7, any of the first tools 40 can be picked out from the receiving unit 23 and then is inserted into the second insertion hole 32 of the operation member 30. By rotating the first part 10 to rotate the first tool 40. Alternatively, by pivoting any of the second tools 50 to le the function end 511 be exposed beyond the first part 10. The user may hold the first part 10 to rotate the second tool 51. The second part 20 can be easily removed from the first space 11 by applying a force to the second engaging portions 25 which are pushed to squeeze the through hole 26 to easily separate the second engaging portions 25 from the first engaging portions 13.

While we have shown and described the embodiment in accordance with the present invention, it should be clear to those skilled in the art that further embodiments may be made without departing from the scope of the present invention.

What is claimed is:

1. A tool assembly comprising:

a first part having a first space defined therein, a first rail formed in each of two insides of the first space, each first rail having a first engaging portion, two second spaces respectively defined in a top and a bottom of the first part, the two second spaces being symmetrical to each other, the first rails located between the first space and the second spaces, two first connection portions defined in each of two sides of a first end of the first part, the two first connection portions are holes, a separation portion located in the first part and located close to the first end of the first part;

a second part having a head and receiving portion, the head being exposed beyond a second end of the first part, the receiving portion inserted into the first space of the first part, a distal end of the receiving portion contacting the separation portion, a second rail formed on each of two sides of the insertion portion, the second rails slidably engaged with the first rails, the receiving portion having multiple receiving units defined in a top and a bottom thereof, each receiving unit having a restriction portion, each second rail having a second engaging portion which is removably engaged with the first engaging portion so as to restrict the receiving portion in the first space, a through hole defined through each of the second rail and located beyond the second engaging portion so that the second engaging portion is pushed to squeeze the through hole when the second engaging portion moves over the first engaging portion, a first connection hole defined in the head of the second part and the first connection hole being a non-circular hole;

an operation member having an insertion which is inserted into the first connection hole of the second part, the operation member having a second insertion hole which is located outside of the second part, the second insertion hole being a hexagonal hole;

multiple first tools being respectively put in the receiving units of the second part and being restricted by the restriction portions, each first tool being picked out from the receiving unit corresponding by forcibly passing over the restriction portion and inserted into the second insertion hole of the operation member;

two second tool units respectively and pivotably connected to the first connection portions of the first part and located in the two second spaces, the second part located between the two second tool units, each of the two second tool units having multiple second tools and multiple separation members, each second tool having a first pivotal portion and a function end on two ends thereof, the function end of each second tool located in the second space, the first pivotal portion of each second tool being pivotable about an axis of the first connection portion corresponding thereto and the function end of each second tool protruding from the first part, each second tool being located between two of the separation members, each separation member having a second pivotal portion which is located in alignment with the first pivotal portion of each second tool and the first connection portion, and two first connection members respectively extending through the two first connection portions, the first pivotal portions and the second pivotal portions of the separation members of the two second tool units so as to pivotally connect the two second tool units to the first part, the second tools being pivotable about the first connection members.

2. The tool assembly as claimed in claim 1, wherein the first engaging portions are circular recesses, the second engaging portions are circular protrusions.

3. The tool assembly as claimed in claim 1, wherein there are eight receiving units and each receiving unit is an elongate and rectangular recess.

4. The tool assembly as claimed in claim 1, wherein the operation member includes a ratchet mechanism.

5. The tool assembly as claimed in claim 1, wherein the first tools are hexagonal wrenches, there are eight or nine first tools.

6. The tool assembly as claimed in claim 1, wherein the second tools each have the bent first pivotal portion and an elongate rod extending from the first pivotal portion, the elongate rod has a hexagonal cross section.

7. The tool assembly as claimed in claim 1, wherein the first connection members each have a threaded section, the two threaded sections of the two first connection members extend through the first part and are threadedly connected to two second connection members which are located in the first connection portions in one side of the first part, the second connection members are screw nuts.

8. The tool assembly as claimed in claim 1, wherein the second part and a combination of the receiving units are two individual elements, the combination of the receiving units is detachably connected to the receiving portion, the receiving portion has a third space and two third engaging portions are connected to two insides of the third space, the third engaging portions are circular recesses, the receiving units are received in the third space and have fourth engaging portions on two sides thereof, the fourth engaging portions are engaged with the third engaging portions, the fourth engaging portions are circular protrusions.

* * * * *